United States Patent [19]

Gratsch

[11] Patent Number: 5,014,453

[45] Date of Patent: May 14, 1991

[54] STEAM PRESS DRAWING AMBIENT AIR IN HEAT EXCHANGE WITH STEAM THROUGH A WORKPIECE AND HAVING TWO PRESSING POSITIONS AND HAVING MOVABLE SPLIT HEAD AND BACK PORTIONS

[76] Inventor: Jack M. Gratsch, 6720 Britton, Cincinnati, Ohio 45227

[21] Appl. No.: 425,534

[22] Filed: Oct. 23, 1989

[51] Int. Cl.[5] ..... D06F 71/00; D06F 71/34; D06F 71/12

[52] U.S. Cl. ..... 38/36; 38/14; 38/15; 38/16; 38/20; 38/66; 38/71; 38/26; 38/27; 38/144

[58] Field of Search ..... 38/5, 6, 15, 16, 17, 38/18, 43, 64, 66, 70, 71, 144; 223/73, 74

[56] References Cited

U.S. PATENT DOCUMENTS

| | | | |
|---|---|---|---|
| 1,876,277 | 9/1932 | Davis | 38/16 |
| 1,996,714 | 4/1935 | Beede | 38/16 |
| 2,007,321 | 7/1935 | Yosyk | 38/16 |
| 2,521,512 | 9/1950 | Gayring | 38/15 |
| 3,430,368 | 3/1969 | wright | 38/21 |
| 4,809,450 | 3/1989 | Hochstrasser | 38/36 |
| 4,910,894 | 3/1990 | Vartan | 38/71 X |

OTHER PUBLICATIONS

The Ultramatic "New Yorker" Trouser Leg Presses Brochure, New York Pressing Machinery Corp.

The Ultramatic Short Oval Legger Brochure, Model AAL-8S.

Hoff-man E-4 Trouser Leg Press, Hoffman Pressing Machinery Corporation.

*Primary Examiner*—Werner H. Schroeder
*Assistant Examiner*—Ismael Izaguirre
*Attorney, Agent, or Firm*—Frost & Jacobs

[57] ABSTRACT

An improved head and buck for a fabric pressing machine, each comprising a hollow casting. The head has an upper steam chamber and a lower spray chamber. A cowling surrounds the head steam chamber, having air intake holes at one end and an air valve near its other end directly connecting the cowling to the spray chamber. The head has a resilient peripheral sealing element engaging a peripheral rim on the buck when the head is closed thereagainst. The buck has a vacuum valve connecting the buck to a source of vacuum. With the head sealed about the buck, air in heat exchange with the head steam chamber within the cowling can be drawn through the workpiece during the drying step of the pressing cycle by opening the buck vacuum valve. The buck is provided with a grid plate, pad and cover assembly which is divided longitudinally into front and rear halves. The front half is fixed on the buck and the rear half is shiftable toward and away therefrom to apply tension to a workpiece transversely of a longitudinal seam therein. In another embodiment both buck halves are shiftable toward and away from each other. The head is made in two longitudinal halves shiftable toward and away from each other. When pressed against the workpiece and the buck, the head halves may be shifted away from each other producing a similar shift in the buck assemblies to apply tension to the workpiece transversely of a seam therein.

20 Claims, 6 Drawing Sheets

STEAM PRESS DRAWING AMBIENT AIR IN HEAT EXCHANGE WITH STEAM THROUGH A WORKPIECE AND HAVING TWO PRESSING POSITIONS AND HAVING MOVABLE SPLIT HEAD AND BACK PORTIONS

TECHNICAL FIELD

The invention relates to an improved head and buck for a fabric pressing machine, and more particularly to a head and a buck which will apply preheated ambient air to the fabric workpiece being pressed during the drying portion of the pressing cycle and which will transversely stretch a seam in the workpiece during the pressing cycle.

BACKGROUND ART

Prior art workers have devised many types of pressing machines. The present invention is directed to that type of pressing machine having a stationary buck and a head shiftable between an open position and a closed position against the buck.

In the usual prior art pressing operation, the fabric workpiece to be pressed is located on the buck and the head of the press is lowered to its closed position, but applies zero pressure to the buck and the workpiece. Steam is introduced into the workpiece via the head or the buck to soften the workpiece and render it manageable. Thereafter, the head is returned to its normal open position and the workpiece is manually smoothed and rendered wrinkle free. At this point, the head is again returned to its closed position against the buck, and is locked under high pressure for a "dwell time" of from about 5 seconds to about 10 seconds. Thereafter, the head is returned to its normal open position and the vacuum valve in association with the buck is opened to cause ambient air to be drawn through the workpiece and the buck to dry the workpiece. The drying step of the pressing cycle generally takes in the neighborhood of from about 17 to about 18 seconds.

The present invention is based upon the discovery that if a cowling is located above and sealed to the steam chamber of the head, and if the cowling is provided at one end with air intake holes and near the other end with a valve which, when open, connects the cowling directly with the spray chamber of the head, and if the head is provided with a peripheral resilient sealing means forming a seal with a peripheral rim on the buck when the head is in its closed, zero pressure position, a number of advantages are achieved. The drying step is conducted with the head in its closed, sealed, zero-pressure position. The air valve of the cowling is opened and the vacuum valve of the buck is also opened. This results in preheated ambient air, having been in heat exchange with the head steam chamber while traveling through the cowling, to be drawn through the workpiece to dry the workpiece. It has been found that this procedure saves air conditioning and prevents air conditioned air from being drawn through the workpiece and creating wet spots therein. Vacuum time is saved and better pressing results The drying step of the pressing cycle is reduced to about 5 seconds, greatly increasing the productivity of the fabric pressing machine.

It has further been found that a longitudinal seam in the workpiece (and particularly a lapped seam as will be described hereinafter) is sharper and straighter if tension is applied to the workpiece, transversely of the seam, during the pressing operation.

As is known in the art, the buck is surmounted by an assembly comprising a grid plate, a pad and a cover of ironing board cloth or drill cloth. In accordance with the present invention, the assembly of the grid plate, pad and cover is split longitudinally to form a front half assembly and a rear half assembly. In one embodiment, the front half assembly is fixed to the buck and the rear half assembly is shiftable on the buck toward and away from the front half assembly. In this way, tension can be applied to the workpiece during the pressing operation.

In another embodiment, both halves of the buck assemblies are shiftable toward and away from each other. In addition, the head of the pressing machine is split longitudinally into two halves, shiftable toward and away from each other by a predetermined distance. Such split heads are known in the art. In this instance, when the head is closed upon the workpiece and the buck, separation of the head halves can result in a similar separation of the buck assembly halves, again applying tension to the workpiece, perpendicular to a longitudinal seam therein.

DISCLOSURE OF THE INVENTION

According to the invention there is provided an improved head and an improved buck for a fabric pressing machine. Each of the head and buck comprises a hollow casting The hollow casting of the head has an upper steam chamber and a lower spray chamber, the lower surface of the head casting being provided with a plurality of perforations leading from the spray chamber. The specific construction of the buck is not a limitation on the present invention. In an exemplary and known construction, the buck is provided with a lower steam chamber and an upper spray chamber, with the upper surface of the buck being provided with a plurality of perforations leading from the spray chamber.

A steam valve, when open, directly connects the steam chamber with the spray chamber of the head, to apply steam to a workpiece being pressed. The buck may similarly be provided with a steam valve, serving the same purpose. The buck is also provided with a vacuum valve which, when open, connects the buck to a vacuum source.

A cowling surrounds and is sealed to the steam chamber of the head. The cowling has air intake holes at one end and an air valve near its other end directly connecting the interior of the cowling to the spray chamber of the head. The head has a resilient sealing element affixed thereto and capable of engaging a peripheral rim on the buck, when the head is closed against the buck either under pressure or at zero pressure. During the drying step of the pressing cycle, the head is closed and sealed against the buck at zero pressure and the air valve of the head and the vacuum valve of the buck are opened. As a result, ambient air is drawn into the cowling and into heat exchange with the head steam chamber. The preheated ambient air is drawn through the air valve to the head spray chamber, and from the head spray chamber through the workpiece into the buck, passing out of the buck via the vacuum valve.

The buck is surmounted by an assembly comprising a grid plate, a pad and a cover. In one embodiment of the buck, this assembly is divided longitudinally into a front half and a rear half. The front half of the assembly is affixed to the buck. The rear half of the assembly is shiftably mounted on the buck, toward and away from the assembly front half. In this way, a workpiece having a longitudinal seam may be located on the front and rear assembly halves with its seam extending along the juncture of the front and rear assembly halves A vacuum is drawn through the assembly halves via the buck and the vacuum valve. The rear assembly half is then shifted away from the front assembly half imparting tension to the fabric transversely of its seam.

In a second embodiment, both the front and rear halves are shiftable on the buck toward and way from each other. In this instance, the pressing machine is provided with a head split along its longitudinal center line so as to have front and rear halves which are shiftable toward and away from each other by a predetermined distance. In this instance, once the workpiece has been located on the front and rear buck assemblies and a vacuum drawn therethrough, the head is closed upon the buck for the baking step and the head halves are shifted a predetermined distance apart, resulting in a similar shift in the buck assemblies, to apply tension to the workpiece transversely of a seam therein.

DETAILED DESCRIPTION OF THE INVENTION

Figure 1:
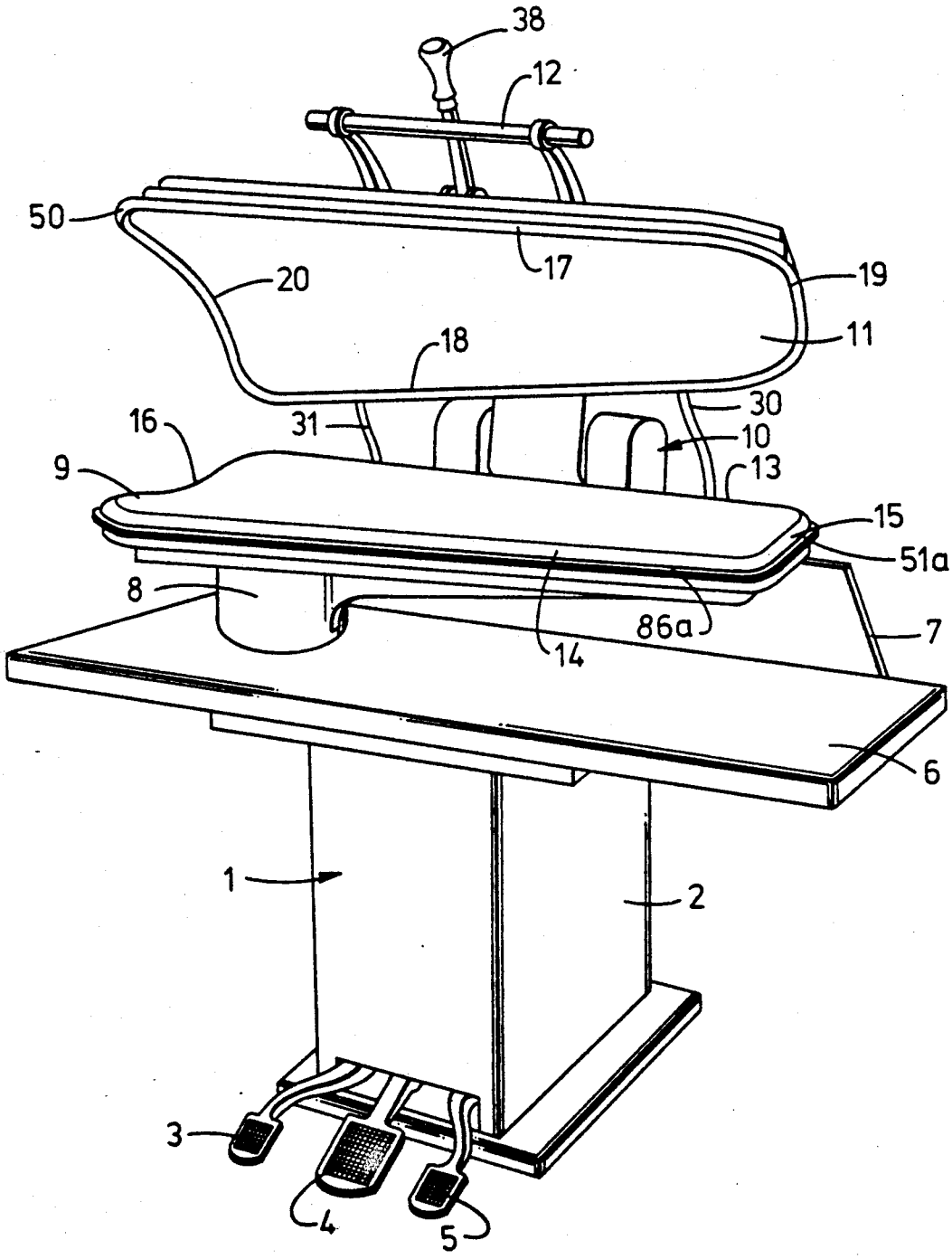
FIG. 1 is a perspective view of an exemplary fabric pressing machine provided with the head and buck of the present invention.

Reference is first made to FIG. 1 wherein a non-limiting, exemplary fabric press is illustrated, provided with the head and buck of the present invention. The pressing machine is generally indicated at 1 and comprises a pedestal 2. The pedestal 2 contains a number of the control elements (not shown) of the pressing machine. These control elements do not constitute a part of the present invention The various operations of the pressing machine 1 may be controlled by foot pedals 3–5, as is conventional. The pedestal supports a table 6, provided with a backboard 7. Mounted on table 6 is a buck support 8, to which the buck 9 is attached.

The pedestal 2 is provided with a large hinge assembly, generally indicated at 10. The hinge assembly 10, in turn, supports the pressing machine head 11. The head 11 may be provided with an operating handle 12. The hinge assembly 10 enables the head 11 to be pivotable between an open position as shown in FIG. 1 and a closed position against the buck 9, as is well known to one skilled in the art.

For purposes of an exemplary showing, the press 1 is illustrated as being provided with a buck 9 and a head 11 of the type used for pressing trouser legs. This is not intended to be a limitation on the present invention, which can be applied to a buck and cooperating head having any appropriate peripheral configuration. As is clear from FIG. 1, the exemplary buck has longitudinal sides 13 and 14 which converge toward the end 15. The opposite end 16 of the buck 9 is provided with an arcuate notch to accommodate the trouser crotch. The head 11 has a similar peripheral configuration, with longitudinal edges 17 and 18 which converge toward the end 19. The head end 20 is arcuately configured to match the shape of buck 9.

Figure 2:
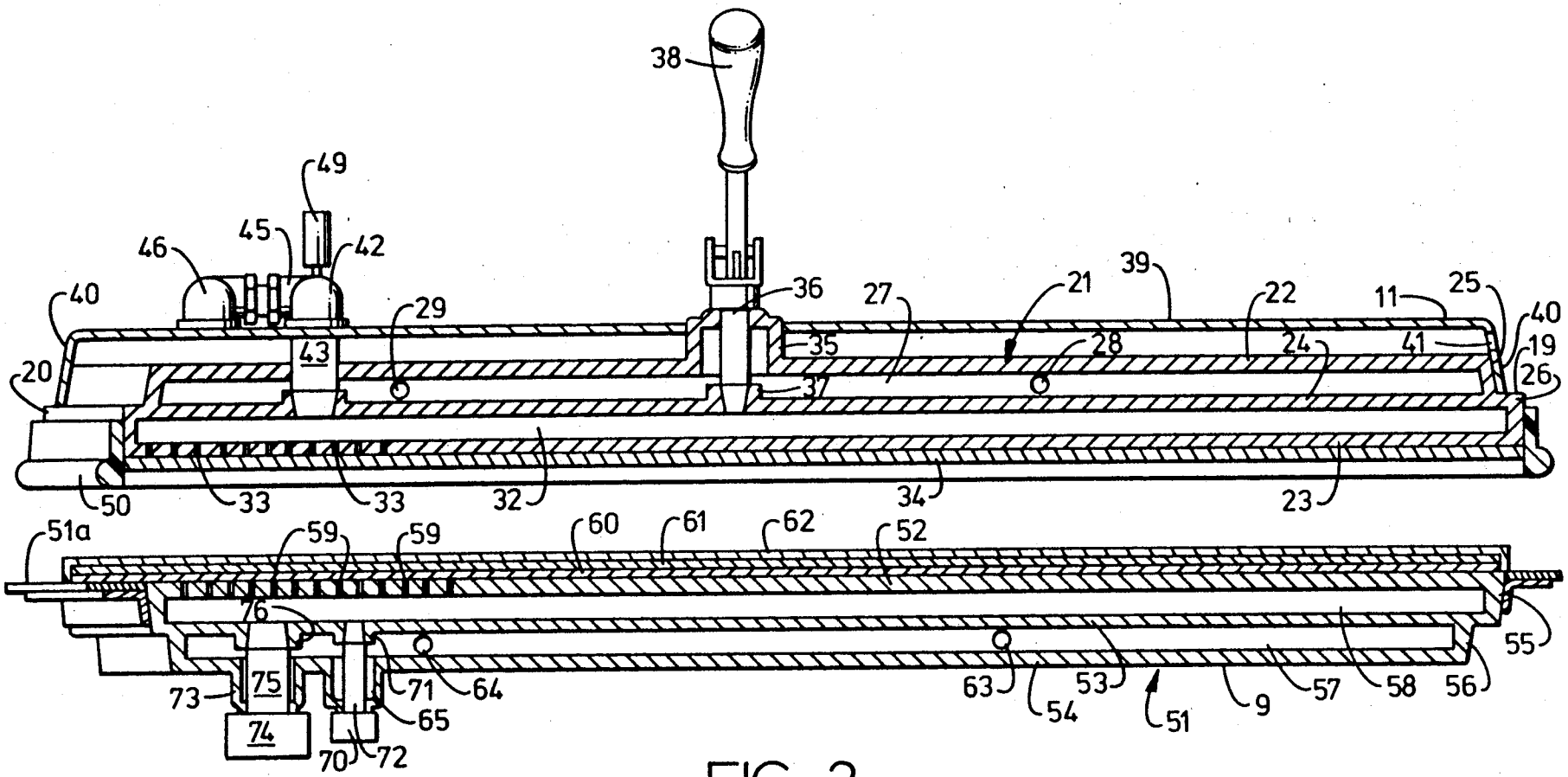
FIG. 2 is a longitudinal cross-sectional view of the head and buck of the present invention.
Figure 3:
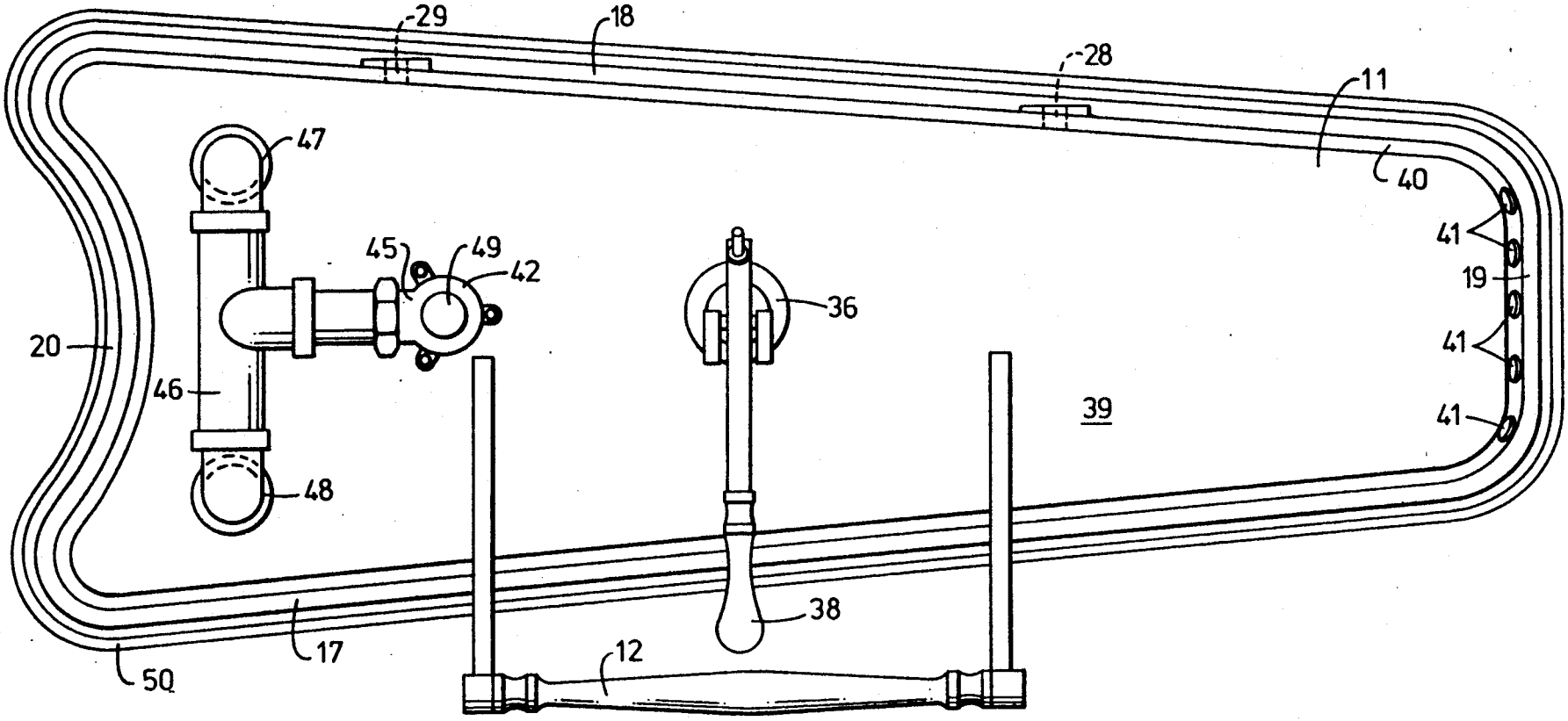
FIG. 3 is a top view of the head of the present invention.

Turning to FIGS. 2 and 3, the head 11 will first be described in detail. The head 11 comprises an aluminum casting generally indicated at 21. The head casting has a top web 22, a planar bottom web 23, and an intermediate web 24. The webs 22–24 are joined together by an integral peripheral side wall 25. The webs 24 and 23 are joined together by an integral peripheral side wall 26. The webs 22, 23 and 24 are additionally joined together by ribs (not shown) extending between webs 24 and 22 and extending between webs 24 and 23. The ribs have been omitted from FIG. 2 for purposes of clarity.

Webs 22 and 24, together with peripheral side wall 25 define an upper or steam chamber 27. The peripheral wall 25 has a perforation 28 therethrough which constitutes a steam inlet. Similarly, the wall 25 is provided with a perforation 29 constituting a steam outlet. Steam inlet 28 and steam outlet 29 are connected by flexible conduits 30 and 31, respectively (see FIG. 1), to a source of steam (not shown).

Web 24 and web 23, together with peripheral wall 26 define a lower or spray chamber 32. The spray chamber 32 is so named because the bottom web 23 is provided with a plurality of perforations (some of which are shown at 33). The perforations 33 are arranged in a pattern throughout the area of web 23. Affixed to the exposed surface of bottom web 23 there is a grid plate 34. The grid plate 34 is a thin metallic member, the thickness of which is greatly exaggerated in FIG. 2. The grid plate 34 substantially covers the entire bottom surface of bottom web 23 and is provided with a plurality of holes (not shown) passing therethrough at various angularities. As a consequence, steam from spray chamber 32, passing through the web perforations 33, is diffused or dispersed in all directions by grid plate 34.

The top web 22 has a boss 35 to which a steam valve unit 36 is affixed. The bottom end of the valve unit 36 is engaged in a boss 37 in intermediate web 24. When in its open position, the normally closed valve unit 36 connects steam chamber 27 with spray chamber 32. The valve unit 36 may be solenoid operated or air operated, or it may be manually operated (as shown in FIGS. 1, 2 and 3). In these FIGURES, the valve unit 36 is illustrated as having an actuating handle 38.

The head 11, as thus far described, is conventional. According to the present invention, the head 11 is provided with a cowling 39 which has a downwardly depending peripheral wall portion 40 affixed to and sealed to (in fluid type fashion) the casting peripheral wall portion 25. The cowling 39 is also sealed to the steam valve unit boss 35. At the end 19 of head 11, the cowling 39 is provided with a plurality of perforations 41. The purpose of these perforations will be apparent hereinafter.

A normally closed air valve assembly is illustrated at 42. The air valve assembly 42 has an outlet 43 which passes through cowling 39 and web 22. The end of the air valve assembly outlet 43 is engaged in a boss 44 in intermediate web 24. It will be understood that the air valve assembly outlet 43 is sealed in fluid type fashion with respect to cowling 39 and webs 22 and 24.

The air valve assembly 42 has an inlet 45 connected to a T-shaped inlet pipe 46 which passes through and is sealingly engaged with the cowling 39 at 47 and 48 (see FIG. 3).

The manner in which the air valve assembly 42 is actuated does not constitute a limitation of the present invention. The air valve assembly is normally closed and may be shifted to its open position manually, by means of compressed air or by a solenoid means, as shown at 49 in FIGS. 2 and 3.

Finally, the head 11 of the present invention is completed by providing a peripheral sealing element 50. The sealing element 50 is made of soft, pliable, rubber or plastic material and extends about the periphery of the head 11, being affixed to the peripheral wall portion 26 of head casting 21. The sealing element 50 is adapted to sealingly engage the buck 9, as will be further explained hereinafter.

Referring specifically to FIG. 2, the buck 9 comprises an aluminum casting generally indicated at 51. The aluminum casting 51 is substantially similar to the aluminum casting 21 of head 11, although it is slightly smaller in peripheral dimension. The buck casting 51 comprises a top web 52, an intermediate web 53 and a bottom web 54. The webs 52–54 are joined together by integral peripheral wall portions 55 and 56. Again, ribs (not shown) extend between webs 52 and 53 and between webs 53 and 54 to strengthen the structure.

The webs 53 and 54 and the peripheral wall portion 56 define a steam chamber 57. Similarly, the webs 52 and 53, together with the peripheral wall portion 55 define a spray chamber 58. It will be understood that the top web 52 is provided with a plurality of perforations 59 throughout its area, similar to the perforations 33 of the head bottom web 23. The upper surface of top web 52 supports a grid plate or diffuser plate 60 similar to the grid plate 34 of head 11. Grid plate 60 is surmounted by a porous pad 61 of felt, rubber or the like. The pad 61, in turn, is covered by a layer of ironing board cloth or drill cloth.

The buck casting 51 is provided with a peripheral rim 51*a* affixed to the casting such that the top surface of rim 51*a* is coplanar with the top surface of casting web 52. The rim 51*a* serves as a seat for head sealing element 50.

In some fabric pressing machines, steam is supplied only through the head 11. In many prior art machines, however, steam is additionally supplied through the buck 9. For purposes of an exemplary showing, the buck 9 of FIG. 2 is illustrated as being of the type which can supply steam to the fabric being pressed. To this end, steam chamber 57 has a first perforation 63 in peripheral wall portion 56 constituting a steam inlet. Steam chamber 57 has a second perforation 64 in peripheral wall portion 56, constituting a steam outlet. The bottom buck web 54 is provided with a boss 65 mounting a steam valve 70. The outlet 71 of steam valve 70 is connected to a boss 72 on intermediate web 53 and extends therethough to the spray chamber 58. It will be understood that the steam valve 70 is sealed with respect to boss 65 and the boss 72. The steam valve 70 is normally closed. When the steam valve 70 is in its open condition, it connects steam chamber 57 with spray chamber 58. The manner in which steam valve 70 is operated does not constitute a limitation on the present invention. Again, it may be solenoid operated, air operated or mechanically operated, as by one of the foot pedals 3–5.

The bottom web 54 of buck 9 is also provided with a second boss 73 in which a vacuum valve 74 is mounted. The inlet 75 of the vacuum valve is connected to a boss 76 of intermediate web 53 and extends therethrough to spray chamber 58. The vacuum valve 74 is sealed both to the boss 73 and the boss 76, and has no connection with the steam chamber 57. The vacuum valve 74, like the steam valve 70, may be operated in any appropriate way including air actuation, solenoid actuation or mechanical actuation.

From the above description, it will be apparent to one skilled in the art that the primary difference between the buck 9 of the present invention and a conventional buck lies in the fact that the rim 51*a* extends beyond the periphery of the casting 51 and is imperforate.

The first embodiment of the present invention having been described in detail, its operation can now be set forth.

The fabric to be pressed is appropriately arranged on the buck. The head is then closed upon the buck, but does not apply pressure thereto. The head sealing element abuts the buck rim 51*a*. At this point, steam is applied to the fabric by opening steam valve 36 and allowing steam from the head steam chamber 27 to enter the spray chamber 32. From the spray chamber 32 the steam passes through the perforations 33 of web 23 and is diffused by grid plate 34. Alternatively, the steam valve 70 of the buck may be shifted to its open position, allowing steam from steam chamber 57 to enter spray chamber 68. From spray chamber 68 the steam passes through perforations 59, grid plate 60, pad 61 and fabric cover 62 into the material to be pressed. The introduction of steam into the fabric to be pressed softens the fabric. At this point, the head 11 is returned to its normal open position and the fabric workpiece is smoothed by hand to relieve it of any wrinkles or the like. Thereafter, the head 11 is reclosed against buck 9, and is locked under high pressure for a "dwell time" of from about 5 seconds to about 10 seconds. This step is frequently referred to in the art as the "baking step".

At this point, according to prior art procedure, the head 11 would be returned to its normal open position and the vacuum valve 74 of buck 9 would be shifted to its open position. This would cause ambient air to be drawn through the workpiece, the fabric layer 62, the pad 61 and the diffuser plate 62 of the buck. The ambient air would flow through the buck perforations 59 and out of the buck via vacuum valve 74.

In accordance with the present invention, however, the head 11 is raised by an amount such that it no longer applies pressure to the workpiece and the buck, but the sealing element 50 maintains a seal with the buck rim 51*a*. The vacuum valve 74 of the buck is opened. Simultaneously, the air valve 42 is opened by solenoid 49. The vacuum from the vacuum valve 74 causes ambient air to enter the openings 41 in the right end (as viewed in FIG. 2) of the head cowling 39. This ambient air passes through the space between the uppermost web 22 of head casting 21 and the cowling to inlet pipe 46. During its passage beneath cowling 39, this ambient air is heated by passing over the uppermost web 22 constituting a part of the head steam chamber 27. The heated ambient air passes through intake pipe 46, valve assembly inlet 45, the valve 42 and its outlet 43 to spray chamber 32. From spray chamber 32, the heated ambient air passes through the head perforations 33 and the grid plate 34 to the workpiece. The vacuum from open vacuum valve 74 draws the heated ambient air through the workpiece, the fabric cover 62, pad 61 and grid plate 60 of the buck 9 and through the buck perforations 59 into the buck spray chamber 58. From here, the heated ambient air is removed from the buck by passing through the vacuum valve 74.

This procedure saves considerable drying time because the workpiece is being dried by ambient air which has been preheated while passing beneath cowling 39 and in heat exchange with the uppermost web 22 of the head. As a consequence, the productivity of the press operator is increased. The procedure of the present invention saves air conditioning, and prevents air conditioned air from being drawn through the workpiece and creating wet spots therein. It also saves vacuum time and produces better pressing results.

Figure 4:
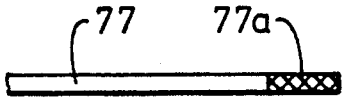
FIG. 4 (PRIOR ART)
FIGS. 4–7 are fragmentary, semi-diagrammatic illustrations of the forming of one type of conventional fabric seam.
Figure 5:
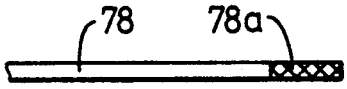
FIG. 5 (PRIOR ART)
Figure 6:
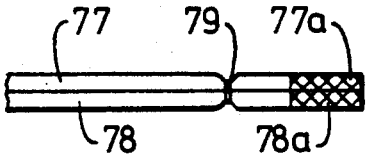
FIG. 6 (PRIOR ART)
Figure 7:
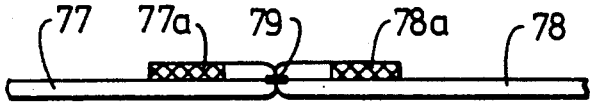
FIG. 7 (PRIOR ART)
Figure 8:
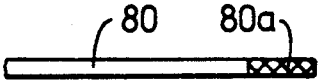
FIG. 8 (PRIOR ART)
FIGS. 8–11 are fragmentary, semi-diagrammatic illustrations of the formation of a second type of conventional fabric seam.

A second embodiment of the present invention is illustrated in FIGS. 13–16. For a better understanding of this embodiment, reference is first made to FIGS. 4–7 which semi-diagrammatically illustrate the formation of a conventional seam between two fabric panels. FIG. 4 illustrates a first fabric panel 77 with its cut edge serged as at 77*a*. FIG. 5 illustrates a second fabric panel 78 with its cut edge serged as at 78*a*. The first panel 77 is laid atop the second panel 78, and the two panels are sewn together as at 79. The panels 77 and 78 are then arranged in opposite directions, as are their serged ends 77*a* and 78*a*. The panels are pressed and the final seam, illustrated in FIG. 7, results. The seam illustrated in FIG. 7 is the conventional type generally found in better clothing and the like.

Figure 9:
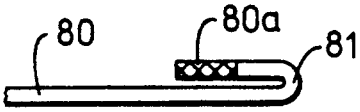
FIG. 9 (PRIOR ART)
Figure 10:
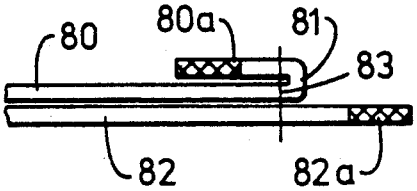
FIG. 10 (PRIOR ART)

FIG. 8–11 illustrate the formation of a conventional seam between panels of the type generally found in lesser lines of clothing and the like, where the nature of the seam is of less importance. The seam of FIGS. 8–11 requires fewer steps and therefor is easier and less expensive to make. In the formation of this conventional seam, a first panel 80 has its cut edge serged, as at 80*a* in FIG. 8. The serged edge of the first panel 80 is then folded over the panel proper, as shown in FIG. 9. In FIG. 9, the fold is indicated at 81. The folded panel 81 is then laid upon a second panel 82 with the fold 81 being spaced inwardly of and substantially parallel to the cut edge of second panel 82. At this stage, the panels are sewn together as at 83 and the cut edge of second panel 82 is simultaneously serged as at 82*a*. It will be noted that the thread 83 sewing the panels 80 and 82 together passes through the first panel 80 twice, adjacent the fold 87, and through the second panel 82 once.

Figure 11:
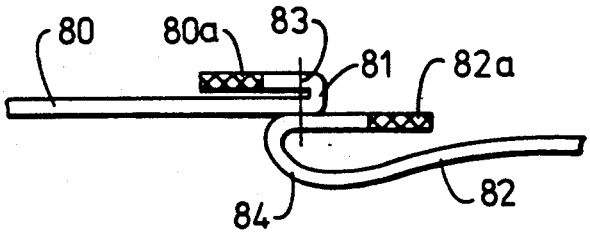
FIG. 11 (PRIOR ART)
Figure 12:
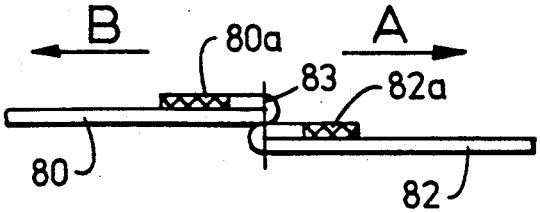
FIG. 12 is a fragmentary, semi-diagrammatic illustration of the seam of FIG. 11 as pressed by a pressing machine employing the head and buck of the present invention.

The next step in the formation of the seam is to cause the first and second panels 80 and 82 to extend in opposite directions and thereafter to press the seam. It is not unusual during the pressing step to encounter difficulties in obtaining a sharp, straight seam. This is because the second panel tends to bulge as at 84, near the line where the panels are sewn together. This is shown in FIG. 11. If this bulge is pressed, a so-called "sandwich" seam is formed. It has been found, however, that a sharp, straight seam can be achieved, as shown in FIG. 12, if the pressing step is performed while panel 82 is lightly pulled in a direction away from panel 80, as indicated by arrow A, or if both panels 80 and 82 are lightly pulled away from each other, as indicated by both arrows A and B.

Figure 13:
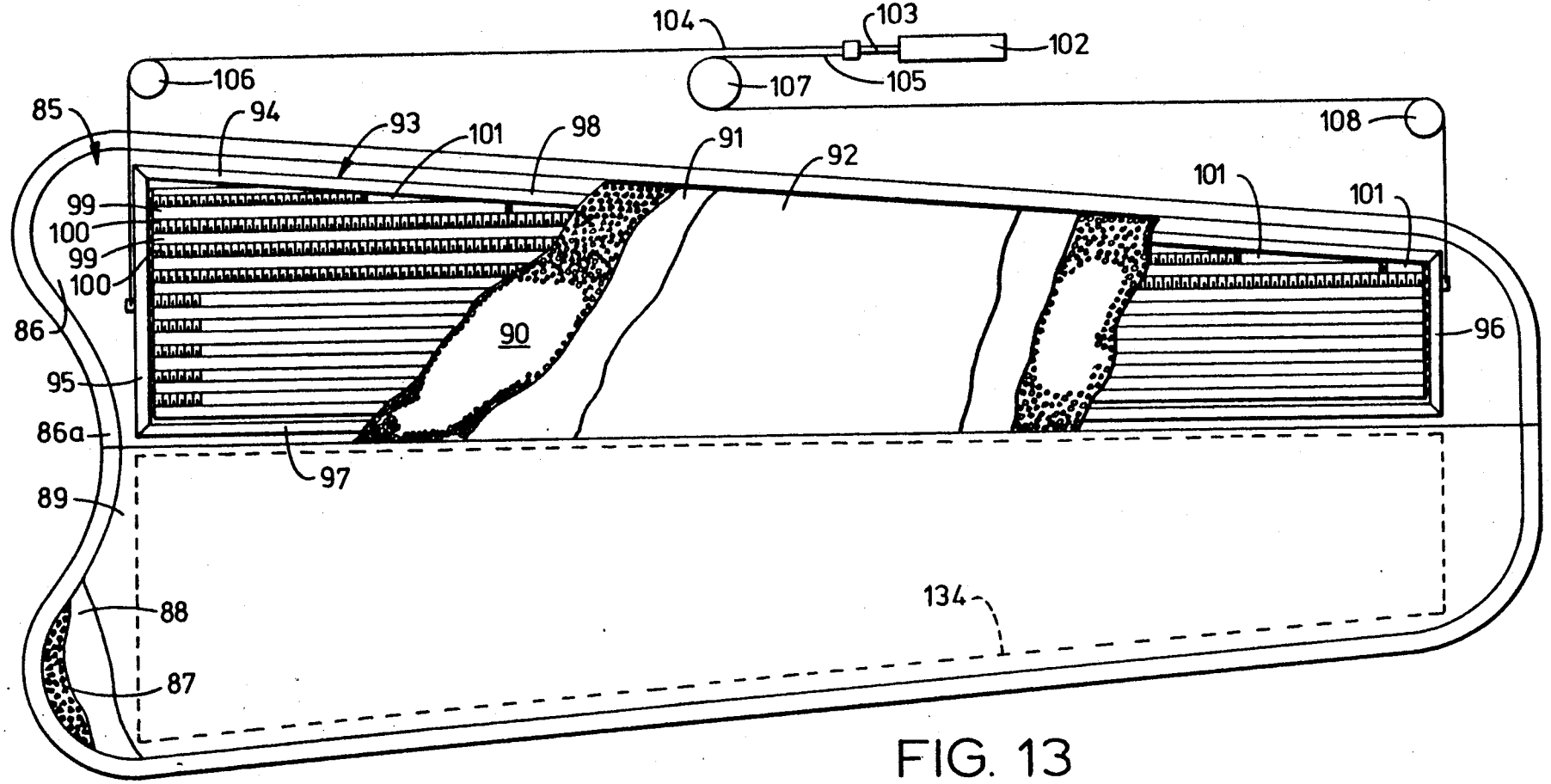
FIG. 13 is a plan view, partly in cross section, illustrating one embodiment of buck of the present invention.

Reference is now made to FIG. 13 which illustrates a modified form of the buck 9 of FIG. 2. The buck 85 of FIG. 13 has an aluminum casting 86 identical to that shown and described with respect to FIG. 2. The aluminum casting 86 is provided with a peripheral rim 86*a* identical to rim 51*a* of FIG. 2. It will be remembered that in the buck 9 of FIG. 2 the aluminum casting 51 is surmounted by a grid plate 60, a pad 61 and a drill cloth cover 62. The same is true of the embodiment of FIG. 13 with the exception that these elements, the grid plate, the pad and the drill cloth, are divided in half longitudinally. To this end, the front half of the buck 85 of FIG. 13 is shown as having a grid plate 87, a pad 88 and a layer of drill cloth 89. In similar fashion, the rear half of the buck 85 is shown provided with a separate grid plate 90, a separate pad 91, and a separate layer of drill cloth 92. The only difference between the front half of buck 85 and buck 9 of FIG. 2 is the fact that the grid plate 87 is raised from the top surface of buck casting 86 by shim means (not shown) to accommodate for the thickness of the roller frame assembly (generally indicated at 93) mounted on the rear half of the buck casting 86, and next to be described. This assures that the grid plate 87 and the grid plate 90 are essentially coplanar.

The roller frame assembly 93 comprises a roller frame 94 having ends 95 and 96 and sides 97 and 98. The roller frame end 96 is shorter than the roller frame end 95 so that the roller frame assembly 93 generally conforms to the shape of the rear half of the buck 85. As a result, the side 98 tapers toward the side 97, sloping toward the frame end 96.

Figure 15:
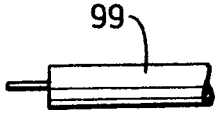
FIG. 15 is a fragmentary elevational view of a non-threaded roller of the present invention.
Figure 14:
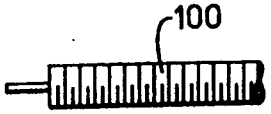
FIG. 14 is a fragmentary elevational view of a threaded roller of the present invention.

The frame ends 95 and 96 rotatively support the ends of a plurality of rollers 99 and 100. The roller 99 and 100 are arranged alternately. The rollers 99 and 100 are parallel and are located side-by-side with minimum clearance therebetween. The rollers 99 are rod-like and have a smooth surface, as shown in FIG. 15. The rollers 100 differ from the rollers 99 only in that their surfaces are threaded as shown in FIG. 14. The threaded surfaces of the rollers 100 assure that steam and/or hot air can pass between adjacent pairs of rollers 99 and 100.

Since the frame end 96 is shorter than the frame end 95, the rollers 99 and 100 nearest the frame side 98 will have one end journaled in the frame end 85 and their other end journaled in pillow blocks 101 mounted on frame side 98. Those rollers 99 and 100 so mounted, will become progressively shorter, as shown in FIG. 13.

The roller frame 93 is freely mounted on the uppermost surface of buck casting 86. Grid plate 90 rests on top of the rollers 99 and 100. Those portions of the grid plate, at the ends thereof, which extend beyond the roller frame assembly 93 are supported by shim means mounted on the upper surface of buck casting 86. The bottom surface of pad 91 is lightly glued to the upper surface of grid plate 90 in such a way that the porosity of the grid plate 90 and pad 91 are not materially affected. In similar fashion, the peripheral edge portions of ironing board or drill cloth 92 are glued to the edges of pad 91.

The rollers 99 and 100 are of such diameter that when they rest upon the top surface of the buck casting 86, the roller frame 94 does not contact the upper surface of the casting. Similarly, when the grid plate 90 rests upon the rollers 99 and 100, it does not contact the roller frame 94.

The amount of tension required to be put on panel 82 in the direction of arrow A (see FIG. 12) to obtain an excellent seam need not be great. As a consequence, the amount by which grid plate 90 shifts rearwardly and away from stationary grid plate 87 also need not be great. Generally, a shift of between ⅛" and ¼" will be sufficient. It will additionally be understood that as the roller frame assembly 93 is shifted a given distance away from grid plate 87, the grid plate 90 will shift twice that distance.

The shifting of roller frame assembly 93 and grid plate 90 may be accomplished in any manner. An exemplary arrangement is illustrated in FIG. 13. A small air cylinder 102, having a piston 103, is mounted to backboard 7 (see FIG. 1). A pair of cables 104 and 105 is affixed to the free end of piston 103. The cable 104 passes about a pulley 106 and is affixed to roller frame 93. The cable 105 passes about a first pulley 107 and a second pulley 108, and is also attached to roller frame 93. It will be understood that pulleys 106, 107 and 108 may be supported from the backboard 7.

As will be evident from FIG. 13, when the air cylinder 102 is actuated so as to cause the piston rod 103 to shift to the right (as viewed in FIG. 13) the cables will cause roller frame 93, grid plate 90, pad 01 and drill cloth cover 92 to shift away from the front half of the buck 85. When the air cylinder 102 is de-energized, so that its piston rod 103 can shift to the left (as shown in FIG. 13) spring means are provided to cause roller frame 93, diffuser plate 90, pad 91 and drill cloth cover 92 to return to their normal position adjacent the front half of buck 85. Spring means for the return of these elements are illustrated in FIG. 16.

Figure 16:
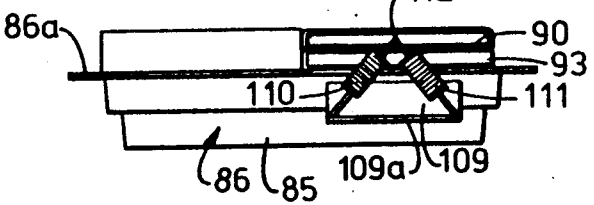
FIG. 16 is an end elevational view of the buck of FIG. 13 illustrating a pair of roller frame springs.

FIG. 16 is an end view of the buck of FIG. 13, as seen from the right. In FIG. 16 a bracket 109 is shown mounted on the end of the aluminum buck casting 86. The bracket 109 extends downwardly and outwardly so that its free end **109*a* extends clear of the buck casting 86. The free end 109*a* of bracket 109 mounts a pair of tension springs 110 and 111. The free end of tension spring 110 is affixed to a central portion of the end of grid plate 90, as at 112. The free end of tension spring 111 is also affixed to the end of grid plate 90, at 112. It will be understood by one skilled in the art that at the opposite end of buck 85 there will be a similar bracket mounting a pair of tension springs equivalent to tension springs 110 and 111, these tension springs being similarly attached to grid plate 90**.

By virtue of this arrangement, the tension springs 110 and 111 and their counterparts (not shown) at the other end of buck 85 serve two purposes. First of all, they urge the grid plate 90 (and the roller frame assembly 93 thereunder) against the top surface of casting 86. In addition, these springs will return the grid plate 90 to its normal position when the cylinder 102 is de-energized.

The buck of FIG. 13 can be used with a head of the type described with respect to FIG. 2. The operation of a press provided with a head identical to head 11 of FIG. 2 and a buck of the type described with respect to FIG. 13 can be described in the following manner. A workpiece provided with a seam of the type described with respect to FIGS. 9–12 is located on the buck with the seam overlying the abutment line between the fixed grid plate 87, pad 88 and drill cloth cover 89 and the shiftable grid plate 90, pad 91 and drill cloth cover 92. The head of the pressing machine is closed on the buck in such a way that the sealing element 50 of the head engages the buck rim **86*a*, but the head does not apply pressure to the buck. Steam is thereafter applied to the workpiece either by means of the head or by means of the buck, as described above with respect to the embodiment of FIG. 2**. The head is then opened and the workpiece is smoothed and rendered free of wrinkles by hand.

At this point, the vacuum valve of the buck is opened and a strong vacuum is drawn through the buck and the workpiece. The cylinder 102 is actuated causing the roller frame assembly 93 to shift rearwardly, this, in turn, causes the grid plate 90 and its pad 91 and cover 92 to shift rearwardly approximately twice the distance of the roller frame assembly imparting stretch to the seam in the direction of arrow A (see FIG. 12).

With the seam stretched, the head is again closed on the buck. This time, however, the head is locked and applies heavy pressure to the buck and the workpiece. This heavy pressure is maintained for from about 5 seconds to about 10 seconds during the bake cycle. The heavy vacuum can be maintained during the bake cycle, or not, depending upon the nature of the fabric of the workpiece. Following the bake cycle, the head is raised by an amount sufficient to no longer apply pressure to the workpiece and the buck, while still maintaining a seal between the head sealing element 50 and the buck rim **86*a*. If the vacuum had been turned off, it is now reinstated and the air valve 42 of the head is opened so that prewarmed ambient air is drawn through the workpiece in the same manner described above with respect to the embodiment of FIG. 2. The head is then opened, and the workpiece is removed from the pressing machine. The fact that the seam was stretched during this procedure will assure a sharp, straight seam of the type illustrated in FIG. 12**.

It will be understood that a pressing machine provided with the head 11 of FIG. 2 and the buck 85 of FIG. 13 could be used to press a seam of the type illustrated in FIG. 7. Furthermore, the buck of FIG. 13 could be used with a conventional head in a conventional manner. Under these circumstances the stretching advantage offered by the buck can be used, but the advantage of drying the workpiece with prewarmed air will be lost. With the use of a conventional head, the drying step will be performed with the head in an open position, simply drawing ambient air through the workpiece by means of the vacuum valve of the buck.

It is known in the art to provide a head for a pressing machine, which head is divided longitudinally in half. The head halves are normally in abutment along the longitudinal centerline, but can be shifted away from each other, by appropriate means. The distance by which the head halves separate is controlled.

Figure 17:
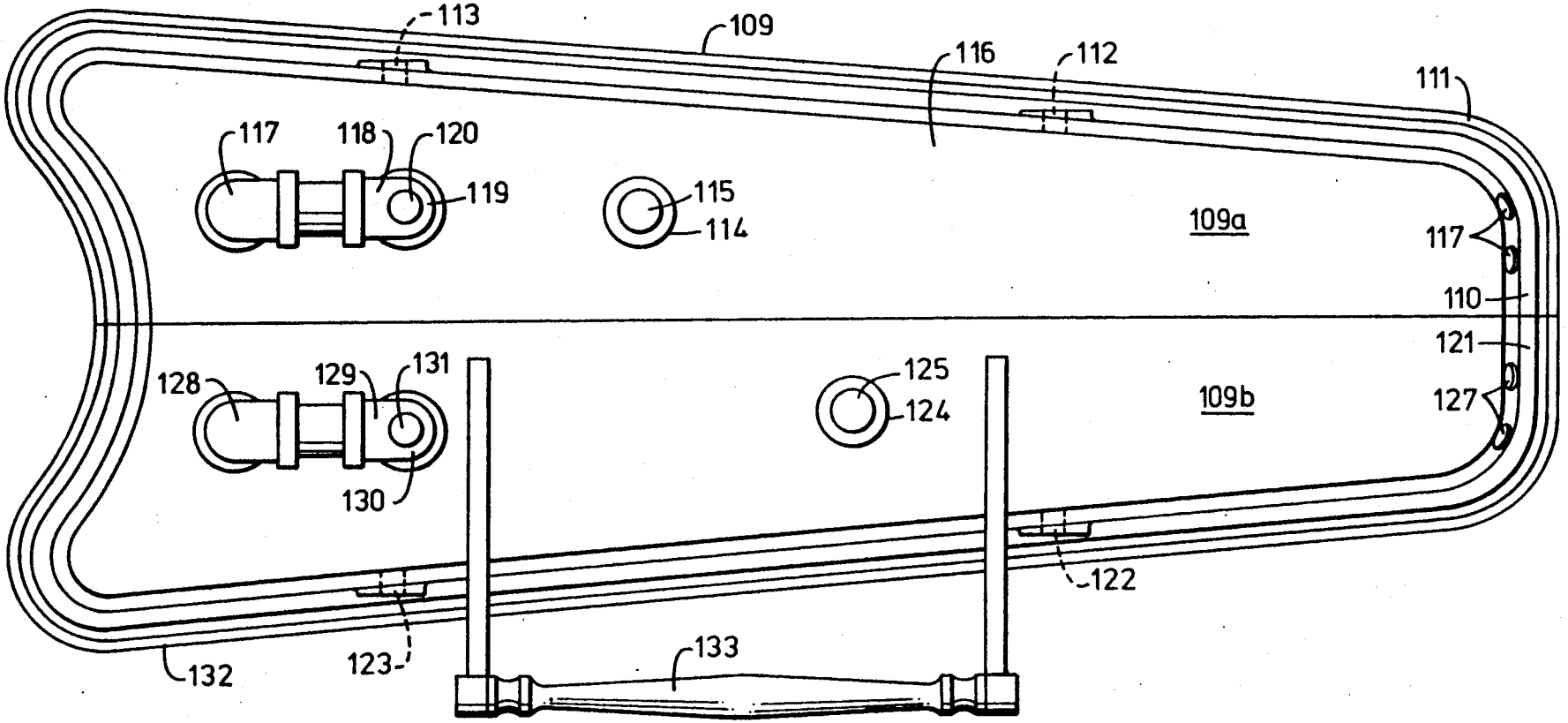
FIG. 17 is a plan view of a split head embodying the teachings of the present invention.

Reference is now made to FIG. 17 wherein a head 109 is shown, similar in construction to the head 11 of FIG. 2. The head 109 differs primarily in the fact that it is made up of two separate halves **109*a* and 109*b*. Each half 109*a* and 109*b* comprises a complete unit having a construction having substantially identical to that described with respect to the head 11 of FIG. 2. To this end, the half 109a comprises an aluminum casting 110 having both a steam chamber and a spray chamber. The bottom surface of the casting 110 is provided with a plurality of perforations (not shown) equivalent to the perforations 33 of head 11. Affixed to the bottom surface of casting 110 there is a grid plate or diffuser plate (not shown), equivalent to the grid plate 34 of FIG. 2. A sealing element 111, identical in configuration to the sealing element 50 of FIG. 2 extends about the tapered side of head half 109a and about its ends. The steam chamber of head half 109 is provided with an inlet 112 and an outlet 113. A steam valve 114 is provided, equivalent to steam valve 36 of FIG. 2. The steam valve 114 may be actuated in any appropriate manner including solenoid actuation, air actuation, or manual actuation. For purposes of an exemplary showing, the steam valve 114 is illustrated as being operated by solenoid 115. Steam valve 114 serves the same purpose as steam valve 36 of FIG. 2**, admitting steam from the steam chamber into the spray chamber when in open condition.

Head half 109a is provided with its own separate cowling 116, equivalent to cowling 39 of FIG. 2. The cowling 116 has openings 117 in its right hand end (as viewed in FIG. 17).

The cowling 116 is provided with an inlet pipe 117 connected to the inlet 118 of an air valve 119. The air valve 119 will have an outlet leading to the spray chamber, in the same manner described with respect to air valve 42 of FIG. 2. The air valve 119 may be operated in any appropriate manner and, for purposes of an exemplary showing, is illustrated as having an actuating solenoid 120.

The head half 109b is essentially a mirror image of head half 109a, and comprises an aluminum casting 121, again providing both a steam chamber and a spray chamber. The bottom surface of casting 121 will be provided with a plurality of perforations similar to the perforations 33 of FIG. 2 and with a grid plate similar to the grid plate 34 of FIG. 2. The steam chamber of the aluminum casting 121 is provided with a steam inlet 122 and a steam outlet 123. It is also provided with a steam valve 124, equivalent to steam valve 114 of head half 109a. The steam valve 124, when open, connects the steam chamber of head half 109b with the spray chamber of head half 109b. Again, for purposes of an exemplary showing, the steam valve 124 is illustrated as being operated by a solenoid 125.

Head half 109b has a cowling 126 equivalent to the cowling 116 of head half 109a, and provided with openings 127 at its right hand end (as viewed in FIG. 17). Cowling 126 has an inlet pipe 128 connected to the inlet 129 of an air valve 130. The inlet valve 130 is identical to inlet valve 119 and serves precisely the same purpose, having an outlet communicating with the spray chamber of head half 109b. Again, for purposes of an exemplary showing, the air valve 130 is illustrated as being operated by solenoid 131. Head half 109b is provided with a sealing element 132 equivalent to sealing element 111, and extending along its long tapered side and its ends.

The head halves 109a and 109b are coupled together and function as a unit. The head halves normally are in abutment, as shown in FIG. 17. As indicated above, however, means (not shown) are provided to separate the head halves by a controlled distance. Any appropriate means may be used for this purpose and the nature of such means does not constitute a limitation of the present invention. Since the head halves 109a and 109b act as a unit, the forward head half 109b may be provided with a handle element 133 equivalent to the handle element 12 of FIG. 3.

In the embodiment presently being described, it is contemplated that the head 109 of FIG. 17 be used with a modified buck. The buck to be used with head 109 is substantially identical to buck 85 of FIG. 13 with two modifications. First of all, the cylinder 102 and cable system attached thereto are eliminated. Secondly, the grid plate 87, the pad 88 and the drill cloth cover 89 on the forward half of the buck are not fixed with respect thereto, but are shiftable in precisely the same manner as described with respect to the grid plate 90 and its pad 91 and cover 92. To this end, the grid plate 87 is mounted on a roller frame assembly, indicated in broken lines at 134. The roller frame assembly 134 is identical to roller frame assembly 93 with the exception that it is a mirror image thereof. Thus, the buck to be used with head 109 is identical to the buck 85 of FIG. 13 with the exception that both grid plates and their associated pads and covers are shiftable toward and away from each other. The head 109 and its modified buck having been described in detail, their operation may now be described. Normally, the head halves 109a and 109b are in abutment, as shown in FIG. 17. The same is true of the separate grid plates and their associated pads and covers on the buck. The seamed workpiece to be pressed is arranged on the buck with the seam overlying the longitudinal abutment line of the buck grid plate, pad and cover assemblies. The head is then closed upon the buck in such a way that it does not apply pressure to either the workpiece or the buck. With the head in its zero-pressure closed position, the workpiece is steamed either via the buck or the head to render the workpiece soft and manageable. The head is then shifted to its open position and the workpiece is finally arranged and rendered wrinkle-free by hand. Thereafter, the head is closed upon the buck and the workpiece and is locked at high pressure. At this point, the head halves are caused to separate by a predetermined, controlled amount (generally from about ⅛" to about ¼"). Since the head is pressing with high pressure against the buck, shifting of the head halves will result in corresponding shifting of the buck grid plates and their respective pads and covers by virtue of roller frames 93 and 134. This will place the seam under tension during the baking step which, again, lasts from about 5 to about 10 seconds. Following the baking step, the head is raised to its zero-pressure position, maintaining sealing elements 111 and 132 in sealing engagement with the peripheral rim 86a on the buck. With the head in this position, vacuum valve of the buck will be opened, and the air valves 119 and 130 of the head halves will simultaneously be opened. This will cause ambient air to be drawn through the openings 117 and 121 in cowlings 116 and 126. As a result, this ambient air will be preheated (as described with respect to FIG. 2) and will be drawn through the head halves, the workpiece and the buck to the vacuum valve thereof. Following the drying step, the head 109 will be shifted to its open position and the head halves 109a and 109b will be returned to their normal closed position. The workpiece will be removed from the buck and the buck grid plates 90 and 134, together with their associated pads and cloth covers will be returned to their normal, abutting positions.

Figure 18:
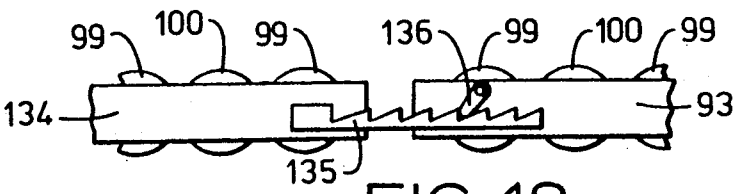
FIG. 18 is a fragmentary end view showing a pair of roller frame assemblies provided with releasable means to maintain them in separated positions.

It will be understood by one skilled in the art that when the head 109 is raised to its zero-pressure position during the drying step, separated head halves will no longer maintain the buck grid plates and their associated heads and covers in separated position. As a result, releasable means must be provided to maintain the buck elements in separated position until the drying step is completed, the head is raised to its open position and the workpiece is removed from the buck. Any appropriate releasable means may be used for this purpose. FIG. 18 is a fragmentary end view of the roller frame assemblies 93 and 134, as seen from the right of FIG. 13. A releasable means is shown in the form of a ratchet 135 affixed to the end of roller frame 134 and a pawl 136 pivotally mounted (as at 137) to roller frame assembly 93. The pawl 136 will engage ratchet 135 and maintain the roller frame assemblies 93 and 134 in their separated positions. The pawl 136 may be spring biased by appropriate spring means (not shown) to its ratchet-engaging position. The pawl 136 may be provided with a laterally extending handle element (not shown) by which it may be manually released when the pressing operation is completed. When the pawl is released, the two roller frame assemblies 93 and 134 will return to their abutting positions, under influence of springs of the type described with respect to FIG. 16. It will be understood that a similar ratchet and pawl arrangement will be provided at the other ends of roller frame assemblies 93 and 134.

It will be understood that the last described buck may be used with a conventional two-part head, not provided with the cowlings 109*a* and 109*b* and the air valves 119 and 130. Under these circumstances, the advantages obtained from stretching the seam of the workpiece will still be realized, but the drying step will be performed in a conventional manner, with the head in open position and the vacuum valve of the buck simply pulling ambient air through the workpiece.

Modifications may be made in the invention without departing from the spirit of it.

What is claimed is:

1. A head and buck for a fabric pressing machine, said head being shiftable between an open position spaced from said buck and either of a closed position against said buck exerting zero pressure thereagainst or a closed position against said buck exerting high pressure thereagainst, said head comprising at least one hollow casting divided internally into an upper steam chamber and a lower spray chamber, said head having a lower surface with a plurality of perforations therethrough leading from said head spray chamber, a normally closed steam valve mounted in said head and connecting said head steam chamber to said head spray chamber when open, a cowling surrounding and sealed to the exterior of said head steam chamber, said cowling having a plurality of air intake holes at one end thereof, a normally closed air valve mounted near the other end of said cowling directly connecting the interior of said cowling to said head spray chamber when open, a resilient sealing element affixed about the periphery of said head spray chamber, said buck comprising a hollow casting divided internally into a lower steam chamber and an upper spray chamber, a normally closed vacuum valve mounted on said buck, said buck having an upper surface with a plurality of perforations formed therethrough leading from said buck spray chamber, a vacuum valve mounted on said buck and directly connecting said buck spray chamber to a source of vacuum when open, a peripheral rim on said buck positioned to be contacted by and form a seal with said sealing element of said head when said head is in either of said zero pressure or high pressure closed positions, whereby during the drying portion of a fabric pressing cycle said head is located in said zero pressure closed position and said air and vacuum valves are opened to draw ambient air through said cowling in heat exchange with said head steam chamber, through said head spray chamber, through a workpiece being pressed, and through said buck spray chamber to said vacuum valve.

2. The head and buck claimed in claim 1 including a grid plate affixed to said head lower surface.

3. The head and buck claimed in claim 1 including a grid plate affixed to the upper surface of said buck, a steam permeable pad mounted on said grid plate, and a steam permeable fabric cover over said pad.

4. The head and buck claimed in claim 1 including a front grid plate half and a rear grid plate half for said buck, said front and rear grid plate halves extending longitudinally of said buck upper surface and each covering substantially one half of said buck upper surface, each of said grid plate halves being surmounted by a steam permeable pad and a steam permeable fabric cover and constituting front and rear grid plate assemblies, said front grid plate assembly being fixed to said buck upper surface, said rear grid plate assembly being shiftable on said buck upper surface between a closed position wherein opposed edges of said front and rear grid plate assemblies abut each other and an open position wherein said rear grid plate assembly is spaced rearwardly of said front grid plate assembly a predetermined distance, means for biasing said rear grid plate assembly to said closed position and means to shift said rear grid plate assembly to said open position, whereby a seamed workpiece is placed on said front and rear grid plate assemblies with the seam aligned with said abutting edges of said front and rear grid plate assemblies and held in place by vacuum drawn through said workpiece, said front and rear grid plate assemblies and said buck, said rear grid plate assembly thereafter being shifted to said open position to impart tension to said workpiece transversely of said seam during selected parts of said pressing cycle.

5. The head and buck claimed in claim 4 including a roller frame assembly, said roller frame assembly comprises a frame member approximating the shape of said rear grid plate assembly, said frame member supporting a plurality of closely spaced rollers extending longitudinally thereof, alternate ones of said rollers having smooth peripheral surfaces throughout the lengths thereof, the remaining rollers being threaded throughout the lengths thereof so that steam passes between the rollers, said roller frame being mounted on said buck upper surface beneath said rear grid plate assembly to render said rear grid plate assembly shiftable between said open and closed positions, said rollers being of such diameter that they contact the upper surface of said buck and the lower surface of said rear grid plate half and maintain said frame member out of contact therewith.

6. The head and buck claimed in claim 5 wherein said means to shift said rear grid plate half to said open position comprises a cylinder actuated cable system, said cylinder being mounted on said pressing machine and said cable system being connected to said roller frame assembly.

7. The head and buck claimed in claim 6 wherein said means to shift said front and rear grid plate assemblies to said open position comprises said head halves, whereby when said head is in said closed position against said buck and exerting high pressure thereagainst and said head halves are shifted to said open position thereof said front and rear grid plate assemblies are shifted thereby to said open position thereof.

8. The head and buck claimed in claim 1 wherein said head is divided longitudinally along the center line thereof into two halves comprising two substantially mirror image hollow castings, each divided internally into an upper steam chamber and a lower spray chamber, said head halves having coplanar lower surfaces with a plurality of perforations therethrough leading from their respective spray chambers, said normally closed steam valve being mounted in one of said head halves and, when open, connecting said steam chamber thereof to said spray chamber thereof, another normally closed steam valve being mounted in the other of said head halves and when open connecting said steam chamber thereof to said spray chamber thereof, said cowling surrounding and sealed to said steam chamber of one of said head halves with said air inlet holes near one end thereof and said air valve mounted near the other end thereof and connecting said spray chamber thereof with the interior of said cowling when open, a second substantially mirror image cowling surrounding and sealed to said steam chamber of the other of said head halves with air inlet holes near one end thereof and a normally closed air valve mounted near the other end connecting the interior of said cowling with said spray chamber of said last mentioned head half when open, said sealing element being in two pieces, one for each head half, and affixed about the peripheries of said spray chambers of said head halves except for those peripheral portions that are opposed, and said head halves being shiftable between a closed position wherein said head halves abut each other along said head longitudinal centerline and an open position wherein said head halves are spaced from each other by a predetermined distance.

9. The head and buck claimed in claim 8 including a front grid plate half and a rear grid plate half for said buck, said front and rear grid plate halves extending longitudinally of said buck upper surface and each covering substantially one half of said buck upper surface, each of said grid plate halves being surmounted by a steam permeable pad and a steam permeable fabric cover and constituting front and rear grid plate assemblies, said front and rear grid plate assemblies being shiftable on said buck upper surface between a closed position wherein opposed edges of said front and rear grid plate assemblies abut each other and an open position wherein said front and rear grid plate assemblies are spaced from each other by a predetermined distance, means to shift said front and rear grid plate assemblies to said open position, and means to retain said front and rear grid plate assemblies in said open position until released, whereby a seamed workpiece is placed on said front and rear grid plate assemblies with the seam thereof aligned with abutting edges of said front and rear grid plate assemblies, said front and rear grid plate assemblies thereafter being shifted to said open position thereof to impart tension to said workpiece transversely of the seam thereof during selected parts of said pressing cycle.

10. The head and buck claimed in claim 9 including a pair of roller frame assemblies, each roller frame assembly comprising a frame member approximating the shape of one of said front and rear grid plate assemblies, each frame member supporting a plurality of closely spaced rollers extending longitudinally thereof, alternate ones of said rollers having smooth peripheral surfaces throughout the lengths thereof, the remaining rollers being threaded throughout the lengths thereof so that steam passes between the rollers, each roller frame being mounted on said buck upper surface beneath one of said front and rear grid plate assemblies to render said front and rear grid plate assemblies shiftable between said open and closed positions, said rollers of each roller frame member being of such diameter that they contact the upper surface of said buck and the lower surface of the respective grid plate half they support and maintain said frame member out of contact therewith.

11. A head for a fabric pressing machine having a buck, said head being shiftable between an open position spaced from said buck and either of a closed position against said buck exerting zero pressure thereagainst or a closed position against said buck exerting high pressure thereagainst, said head comprising at least one hollow casting divided internally into an upper steam chamber and a lower spray chamber, said head having a lower surface with a plurality of perforations therethrough leading from said head spray chamber, a normally closed steam valve mounted in said head and connecting said head steam chamber to said head spray chamber when open, a cowling surrounding and sealed to the exterior of said head steam chamber, said cowling having a plurality of air intake holes at one end thereof, a normally closed air valve mounted near the other end thereof directly connecting the interior of said cowling to said head spray chamber when open, a resilient sealing element affixed about the periphery of said head spray chamber, said sealing element forming a seal against said buck when said head in either of said zero pressure and high pressure closed positions.

12. The head claimed in claim 11 wherein said head is divided along a longitudinal centerline into two halves comprising two substantially mirror image hollow castings each divided internally into an upper steam chamber and a lower spray chamber, said head halves having coplanar lower surfaces with a plurality of perforations therethrough leading from the respective spray chambers thereof, said normally closed steam valve being mounted in one of said head halves and when open, connecting said steam chamber thereof to said spray chamber thereof, another normally closed steam valve being mounted in the other of said head halves and when open connecting said steam chamber thereof to said spray chamber thereof, said cowling surrounding and sealed to said steam chamber of one of said head halves with said air inlet holes near one end thereof and said air valve mounted near the other end thereof and connecting said spray chamber thereof with the interior of said cowling when open, a second substantially mirror image, cowling surrounding and sealed to said steam chamber of the other of said head halves with air inlet holes near one end thereof and a normally closed air valve mounted near the other end thereof connecting the interior of said cowling with said spray chamber of said last mentioned head half when open, said sealing element being in two pieces, one for each head half, and affixed about the peripheries of said spray chamber of said head halves except for those peripheral portions that are opposed, and said head halves being shiftable between a closed position wherein said head halves abut each other along said head longitudinal centerline and an open position wherein said head halves are spaced from each other by a predetermined distance.

13. A buck for a fabric pressing machine having a head shiftable between an open position spaced from said buck and either of a closed position against said buck exerting zero pressure thereagainst or a closed position against said buck exerting high pressure thereagainst, said buck comprising a hollow casting divided internally into a lower steam chamber and an upper spray chamber, said buck having an upper surface with a plurality of perforations formed therethrough leading from said buck spray chamber, a normally closed vacuum valve mounted on said buck and when open, directly connecting said buck spray chamber to a source of vacuum, a peripheral rim on said buck positioned to be contacted by and form a seal with a peripheral sealing element on said head when said head is in either of said zero pressure and high pressure closed positions.

14. A buck for a fabric pressing machine having a head, said buck comprising a hollow casting divided internally into a lower steam chamber and an upper spray chamber, said buck having an upper surface with a plurality of perforations formed therethrough leading from said buck spray chamber, a normally closed vacuum valve mounted on said buck and when open, directly connecting said buck spray chamber to a source of vacuum, a front grid plate half and a rear grid plate half for said buck, said front and rear grid plate halves extending longitudinally of said buck upper surface and each covering substantially one half of said buck upper surface, each of said grid plate halves being surmounted by a steam permeable pad and a steam permeable fabric cover and constituting front and rear grid plate assemblies, said front grid plate assembly being fixed to said buck upper surface, said rear grid plate assembly being shiftable on said buck upper surface between a closed position wherein opposed edges of said front and rear grid plate assemblies abut each other and an open position wherein said rear grid plate assembly is spaced rearwardly of said front grid plate assembly by a predetermined distance, means for biasing said rear grid plate assembly to said closed position and means to shift said rear grid plate assembly to said open position.

15. The buck claimed in claim 14 including a roller frame assembly, said roller frame assembly comprising a frame member approximating the shape of said rear grid plate assembly, said frame member supporting a plurality of closely spaced rollers extending longitudinally thereof, alternate ones of said rollers having smooth peripheral surfaces throughout the lengths thereof, the remaining rollers being threaded throughout the lengths thereof so that steam passes between the rollers, said roller frame being mounted on said buck upper surface beneath said rear grid plate assembly to render said rear grid plate assembly shiftable between said open and closed positions thereof, said rollers being of such diameter that they contact the upper surface of said buck and the lower surface of said rear grid plate half and maintain said frame member out of contact therewith.

16. A buck for a fabric pressing machine having a head, said buck comprising a hollow casting divided internally into a lower steam chamber and an upper spray chamber, said buck having an upper surface with a plurality of perforations formed therethrough leading from said buck spray chamber, a normally closed vacuum valve mounted on said buck and when, open, directly connecting said buck spray chamber to a source of vacuum, a peripheral rim on said buck positioned to be contacted by and form a seal with a sealing member on said head, a front grid plate half and a rear grid plate half for said buck, said front and rear grid plate halves extending longitudinally of said buck upper surface and each COvering substantially one half of said buck upper surface, each of said grid plate halves being surmounted by a steam permeable pad and a steam permeable fabric cover, and constituting front and rear grid plate assemblies, said front and rear grid plate assemblies being shiftable on said buck upper surface between a closed position wherein opposed edges of said front and rear grid plate assemblies abut each other and an open position wherein said front and rear grid plate assemblies are spaced from each other by a predetermined distance, means to shift said front and rear grid plate assemblies to said open position, and means to retain said front and rear grid plate assemblies in their open position until released.

17. The improved buck claimed in claim 16 including a pair of roller frame assemblies, each roller frame assembly comprising a frame member approximating the shape of one of said front and rear grid plate assemblies, each frame member supporting a plurality of closely spaced rollers extending longitudinally thereof, alternate ones of said rollers having smooth peripheral surfaces throughout the lengths thereof, the remaining rollers being threaded throughout the lengths thereof so that steam passes between the rollers, each roller frame being mounted on said buck upper surface beneath one of said front and rear grid plate assemblies to render said grid plate assemblies shiftable between said open and closed positions, said rollers of each roller frame member being of such diameter that they contact the upper surface of said buck and the lower surface of their respective grid plate half and maintain the respective frame member thereof out of contact therewith.

18. A fabric pressing machine having a fixed buck and a head shiftable between an open position spaced from said buck and either of a closed position against said buck exerting zero pressure thereagainst or a closed position against said buck exerting high pressure thereagainst, means to form a seal between said head and said buck when said head is n either of said closed positions, and means to draw preheated ambient air through said head and said buck when said head is in either of said closed positions whereby to dry a fabric workpiece located on said buck.

19. A fabric pressing machine having a head and a buck, a front grid plate half and a rear grid plate half for said buck, said front and rear grid plate halves extending longitudinally of said buck upper surface and each covering substantially one half of said buck upper surface, each of said grid plate halves being surmounted by a steam permeable pad and a steam permeable fabric cover and constituting front and rear grid plate assemblies, at least one of said grid plate assemblies being shiftable on said buck upper surface between a closed position wherein opposed edges of said front and rear grid plate assemblies abut each other and an open position wherein said front and rear grid plate assemblies are spaced from each other by a predetermined distance, means for biasing said at least one shiftable grid plate assembly to said closed position and means to shift said at least one shiftable grid plate assembly to said open position.

20. A fabric pressing machine having a fixed buck and a split head comprising two longitudinal halves, said head halves being shiftable between a closed position wherein they are in abutment and an open position wherein they are spaced from each other by a predetermined distance, said head being shiftable between an upper position spaced from said buck and a lower position against said buck, a front grid plate half and a rear grid plate half for said buck, said front and rear grid plate halves extending longitudinally of said buck upper surface and each covering substantially one half of said buck upper surface, each of said grid plate halves being surmounted by a steam permeable pad and a steam permeable fabric cover and constituting front and rear grid plate assemblies, said front grid plate assembly and said rear grid plate assembly being shiftable on said buck upper surface between a closed position wherein opposed edges of said front and rear grid plate assemblies abut each other and an open position wherein said grid plate assemblies are spaced from each other by a predetermined distance, means to shift said grid plate assemblies to said open position thereof, said last mentioned means comprising said split head which when closed against said buck and when said head halves are shifted to said open position thereof, said grid plate assemblies will shift therewith to said open position thereof.

* * * * *